US005941723A

United States Patent [19]

Yu

[11] Patent Number: 5,941,723

[45] Date of Patent: Aug. 24, 1999

[54] CARD EDGE CONNECTOR APPARATUS

[75] Inventor: Wang-I Yu, Taipei, Taiwan

[73] Assignee: Berg Technology, Inc., Reno, Nev.

[21] Appl. No.: 08/785,700

[22] Filed: Jan. 17, 1997

Related U.S. Application Data

[63] Continuation of application No. 08/364,238, Dec. 27, 1994, abandoned.

[51] Int. Cl.[6] ..... H01R 13/62

[52] U.S. Cl. ..... 439/328; 439/630; 439/488

[58] Field of Search ..... 439/56–62, 326–329, 439/629–637, 488, 491

[56] References Cited

U.S. PATENT DOCUMENTS 5,203,714 4/1993 Tuan ..... 439/329 X
5,267,872 12/1993 Gou et al. ..... 439/326
5,387,115 2/1995 Kozel et al. ..... 439/328 X
5,389,000 2/1995 Diviesti et al. ..... 439/328 X

*Primary Examiner*—Khiem Nguyen
*Attorney, Agent, or Firm*—Daniel J. Long; M. Richard Page

[57] ABSTRACT

Disclosed is a card edge connector having mirror image latches which are integrally molded into the housing and which have horizontal latch manipulation platform members which extend outwardly from their body section. A stopper member is positioned outwardly from the latches to prevent overstressing when the latches are deflected. The horizontal latch manipulation has a central major slot and a peripheral secondary slot which are vertically aligned respectively with a vertical slot between the latch body and the stopper member and the top surface of the stopper member to allow for relatively easy molding of the latch. A separately molded finger engagement portion may be inserted into the central principal slot which the stopper member is received by the secondary slot when the latch is flexed. The finger engagement portion may advantageously be of a different color from the housing to make it easier to locate.

21 Claims, 5 Drawing Sheets

FIG. 7
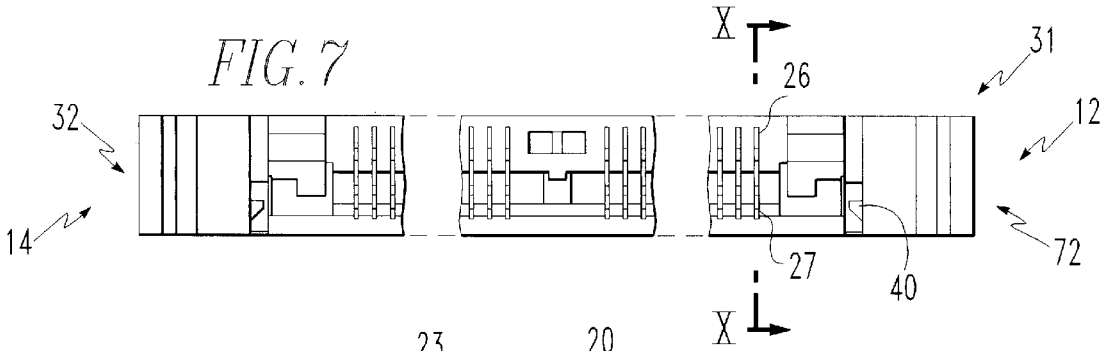
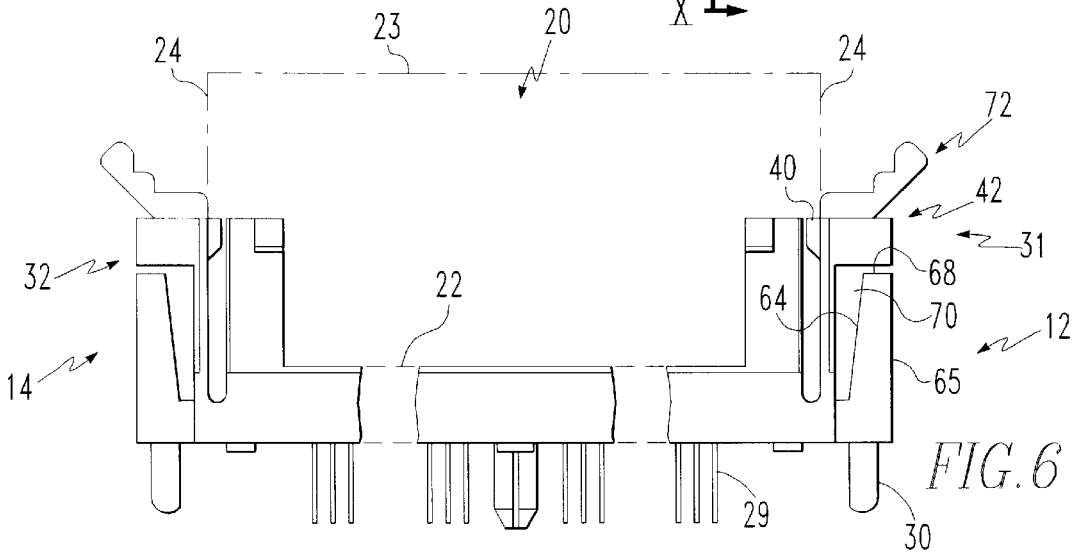
FIG. 6
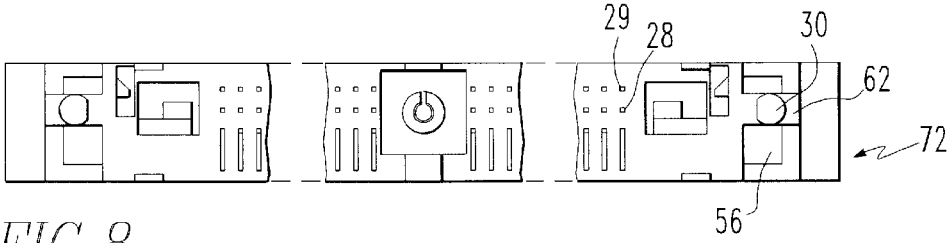
FIG. 8
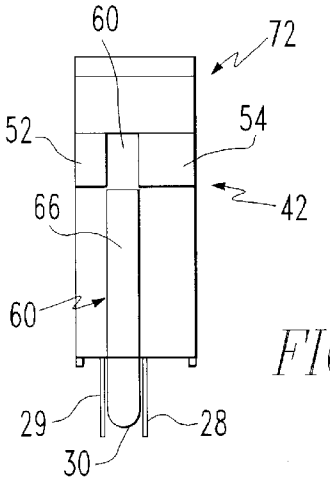
FIG. 9

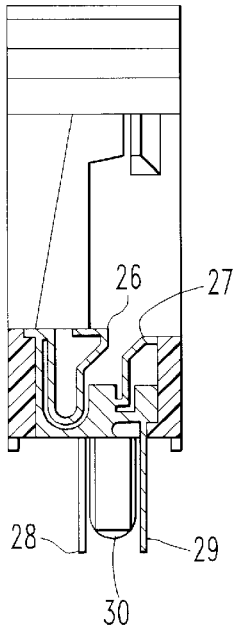
FIG. 10
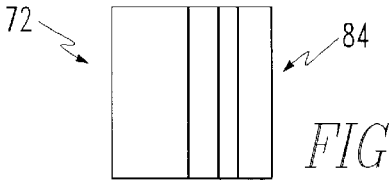
FIG. 13
FIG. 14
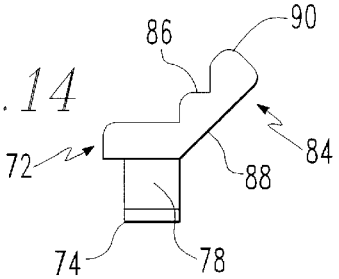
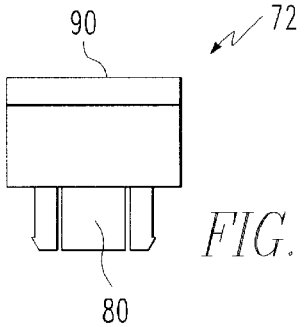
FIG. 15
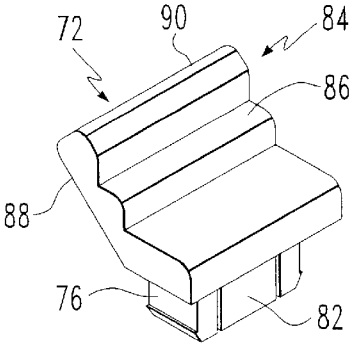
FIG. 11
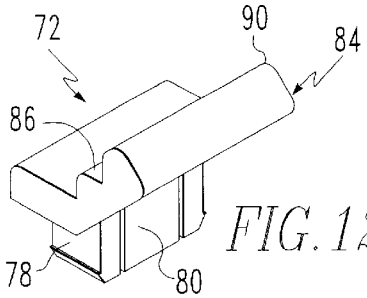
FIG. 12

CARD EDGE CONNECTOR APPARATUS

This application is a continuation of application Ser. No. 08/364,238, filed Dec. 27, 1994 abandoned.

BACKGROUND OF INVENTION

1. Field of the Invention

The present invention relates to electrical connectors and more particularly to card edge connectors.

2. Brief Description of Prior Developments

Cards are removed from single in line memory modules (SIMM) and other such card edge connector apparatus by means of resilient latches positioned at opposite ends of the card receiving groove. Largely because of durability considerations, metal latches have commonly been used for this purpose. Such metal latches may, however, be expensive and may demand close control of dimensional tolerances so that they may be satisfactorily fit into their receiving sockets.

Plastic latches which are integrally molded into the housing are also employed in card edge connectors. In order to increase the durability of such plastic latches, anti-overstressing outward stopper members are often positioned outwardly of the latches to limit their outward deflection. Such latches are also typically equipped with a finger engagement portion at the upper end of their bodies. While such finger engagement portions may facilitate the manipulation of the latches, they may render the latch complex to manufacture by injection molding techniques when it is also necessary to allow for the stopper member. There is, therefore, a need for a plastic molded latch for card edge connectors which is durable and which may be easily manufactured.

Another advantage which metal latches are considered to have over plastic latches is that they are usually easily distinguishable by visual means from the surrounding insulative material. Integrally molded plastic latches on the other hand, generally have the same color and reflectivity as the rest of the housing. Plastic latches may, therefore, not be readily discerned by visual means so that the overall process of replacing cards in connectors equipped with plastic latches may proceed somewhat more slowly than in connectors equipped with metal latches. Accordingly, a need also exists for a plastic latch which is readily visible to persons working with them.

SUMMARY OF THE INVENTION

In the card edge connector of this invention, mirror image latches are positioned at the opposed sides of the elongated channel in the insulated housing or a single latch is positioned at one end of the elongated housing. Each of these latches comprises a body portion which extends vertically from the housing and which has on its inner end an inward extension which engages the card edge. On its outer side is a latch manipulation platform member which preferably is a pair of longitudinal arms having transverse elements at their terminal end. A principal slot is formed between the longitudinal arms, and a secondary slot is formed between the ends of the transverse extensions. A horizontal member extends from the lower part of the body and connects to an outward stopper member which extends upwardly to be aligned with the secondary slot in the engagement member. A finger engaging portion having a lower base section and an upwardly and outwardly extending arm fits into the principal slot formed in the engagement member. When the latch is deflected outwardly, the stopper member will be received in the longitudinal slot. The principal slot is vertically aligned with a vertical slot between the body of the latch and the stopper member and the secondary slot is vertically aligned with the top surface of the stopper member so that the latch may be produced with relative ease by conventional injection molding techniques. Since the finger engagement portion is molded as a separate piece, it can be produced in a color which is different from the rest of the insulative housing so as to make it visually distinguishable and thus easier to locate and manipulate.

BRIEF DESCRIPTION OF THE DRAWINGS

The card edge connector of the present invention is further described with reference to the accompanying drawings in which:

FIG. 6 is a side elevational view of the card edge connector shown in FIG. 2;

FIG. 7 is a top plan view of the card edge connector shown in FIG. 2;

FIG. 8 is a bottom plan view of the card edge connector shown in FIG. 2;

FIG. 9 is an end view of the card connector shown in FIG. 2;

FIG. 10 is a cross sectional view through line X—X in FIG. 7;

FIG. 11 is an inner side perspective view of the finger engagement portion;

FIG. 12 is an outer side perspective view of the finger engagement portion shown in FIG. 11;

FIG. 13 is a top plan view of the finger engagement portion shown in FIG. 11;

FIG. 14 is a side elevational view of the finger engagement portion shown in FIG. 11;

FIG. 15 is an outer end view of the finger engagement portion shown in FIG. 11;

DETAILED DESCRIPTION OF THE PREFERRED EMBODIMENT

Figure 1:
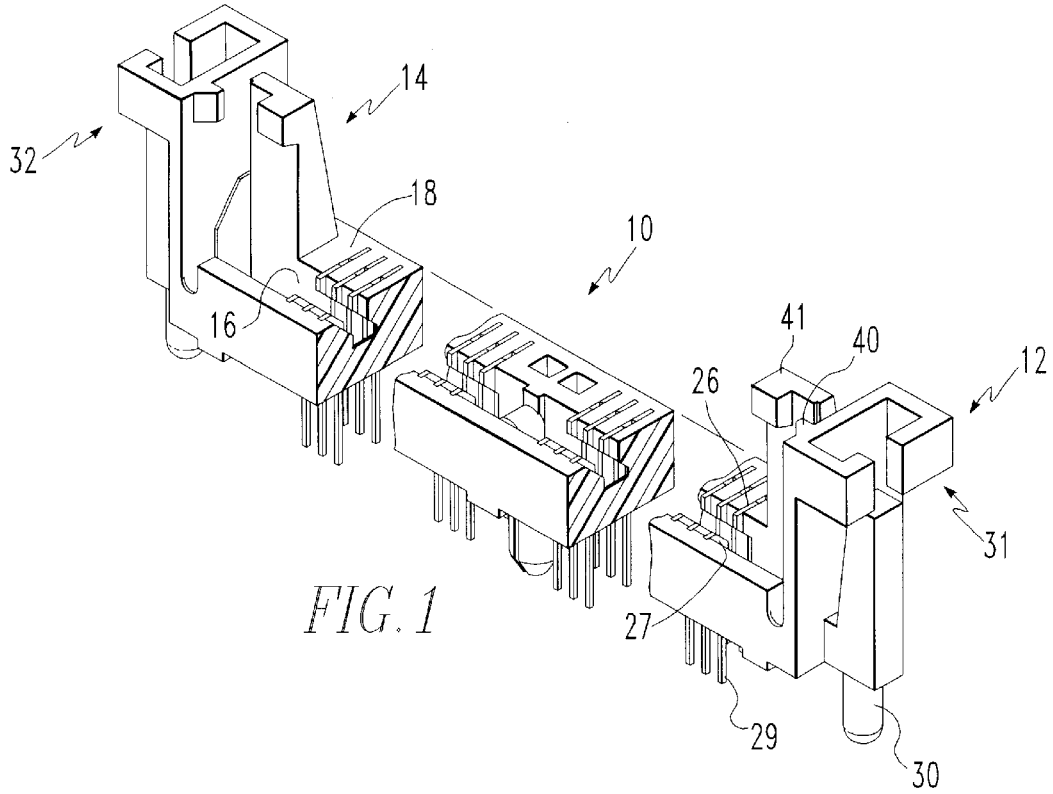
FIG. 1 is a perspective view of a preferred embodiment of the card edge connector.
Figure 2:
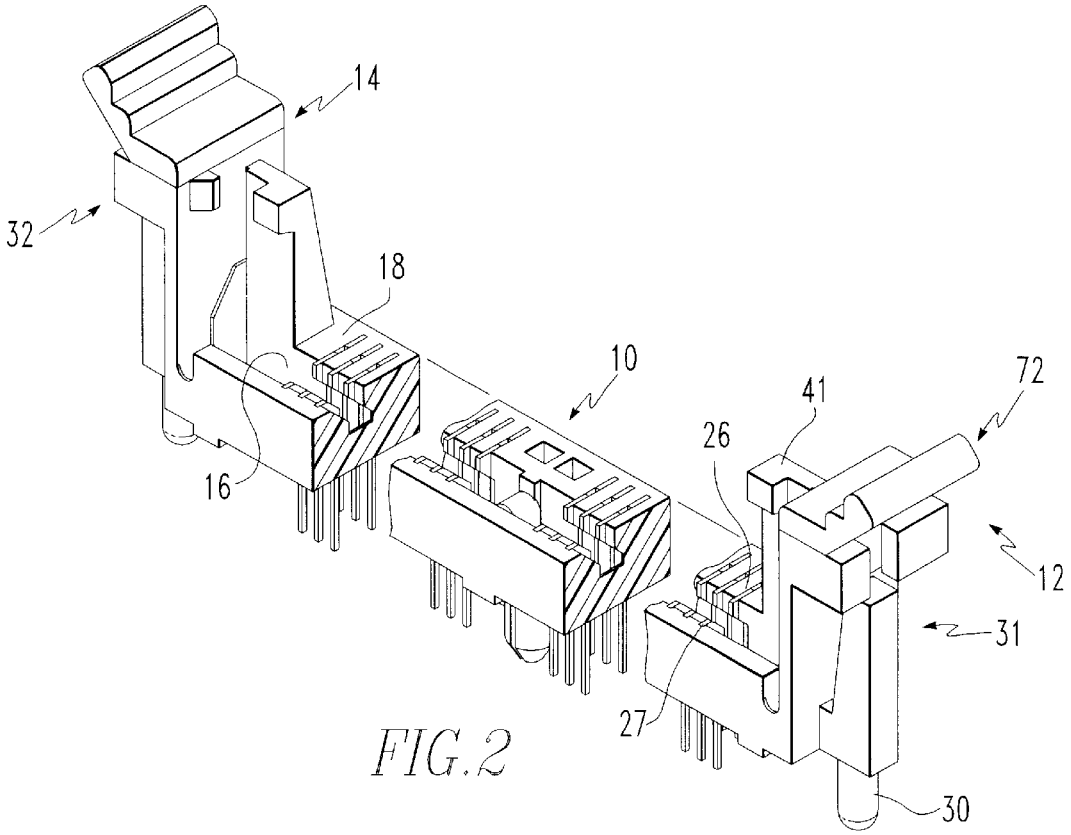
FIG. 2 is a perspective view of a preferred embodiment of the card edge connector shown in FIG. 1 with the lever arm engaged.
Figure 4:
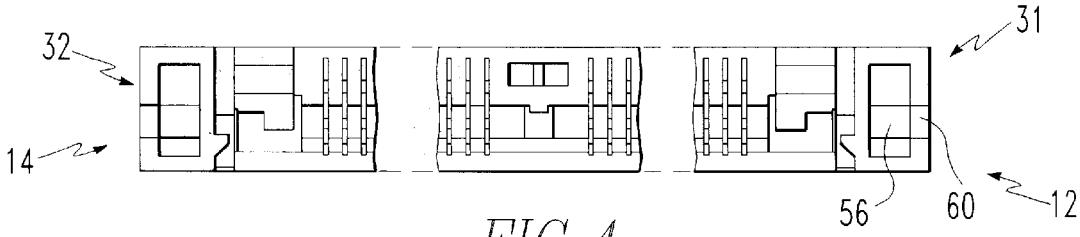
FIG. 4 is a top plan view of the card edge connector shown in FIG. 1.
Figure 3:
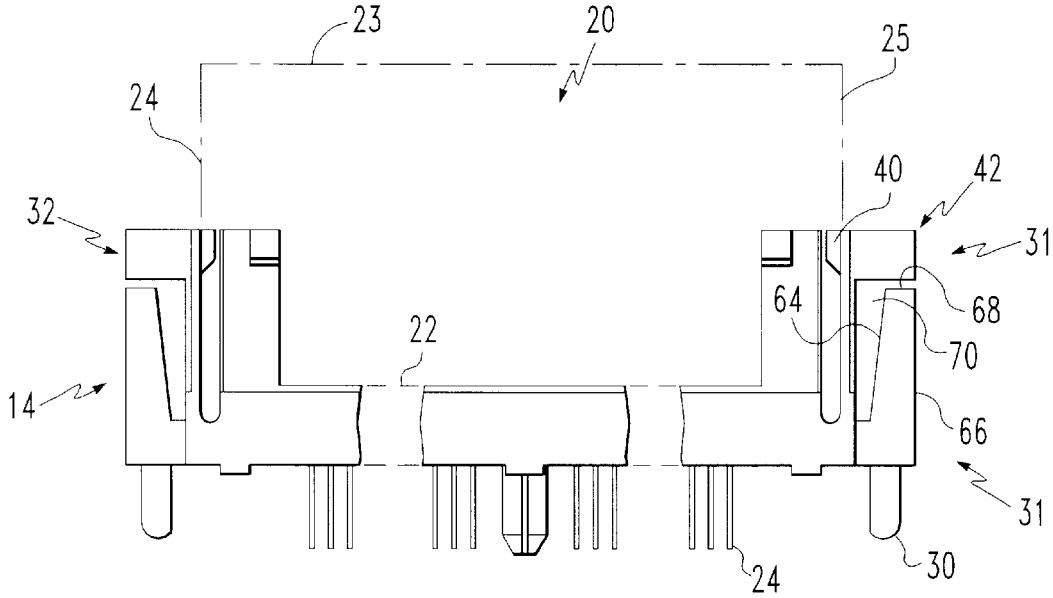
FIG. 3 is a side elevational view of the card edge connector shown in FIG. 1.
Figure 5:
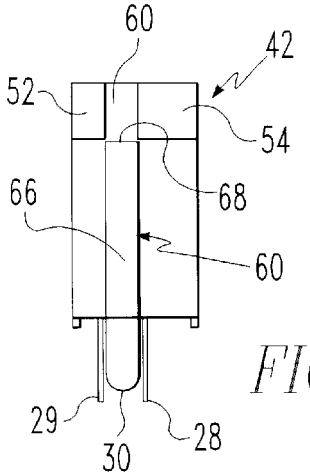
FIG. 5 is an end view of the card connector shown in FIG. 1.

Referring to FIGS. 1–5, the card edge connector of the present invention includes an elongated electrical insulating material housing shown generally at numeral 10. Preferably this material is a moldable plastic-like material such as a liquid crystal polymer. This housing includes a first end 12 and a second housing end 14. Interposed between these ends there is an elongated card edge receiving channel 16 in the top side 18 of the housing. This channel receives a circuit board shown generally in phantom lines at numeral 20 (FIGS. 3 and 6) which has a front edge 22, which is inserted in the channel, a top edge 23 and side edges 24 and 25. As is conventional, conductive tabs (not shown) on the circuit board engage electrical contacts as at 26 and 27 which are connected to terminal pins as at 28 and 29. Plastic pins as at 30 also extend downwardly from the housing. On the first and second ends of the housing there is a first latch mechanism shown generally at numeral 31 and a second latch mechanism shown generally at numeral 32. While only latch mechanism 31 is described below in detail, it will be understood that these latch mechanisms are mirror images of each other and are otherwise essentially identical.

Figure 16:
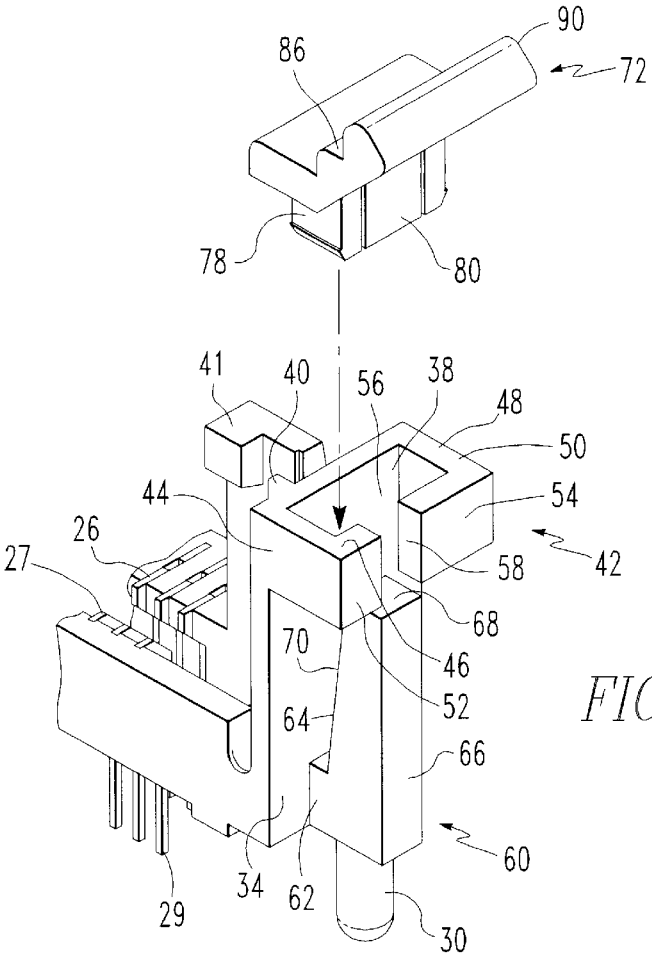
FIG. 16 is an enlarged, view of the latch member of the connector shown in FIG. 1 in which the lever arm is not engaged.
Figure 17:
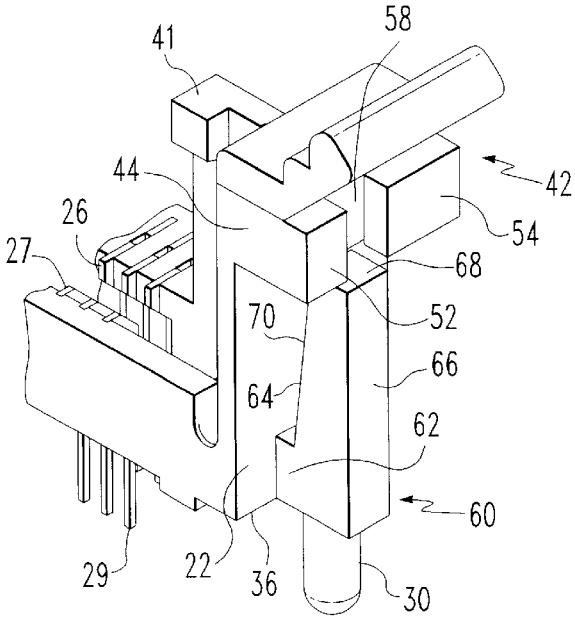
FIG. 17 is an enlarged view of the latch member of the connector shown in FIG. 3 in which the lever arm is engaged.

Referring particularly to FIGS. 16 and 17, it will be seen that the latch mechanism 31 includes a body section 34 which has a lower end 36 and an upper end 38. It also includes an inward extending projection 40 and card engagement arm 41. A horizontal latch manipulation member generally at numeral 42 extends perpendicularly outwardly from the body and includes horizontal longitudinal arm 44 having a terminal end 46 and a parallel longitudinal arm 48 which has a terminal end 50. At each of these terminal ends there are, respectively, transverse extensions 52 and 54 which extend toward each other. A principal central slot 56 is formed between the longitudinal arms and a secondary peripheral slot 58 is formed between the ends of the transverse extensions 52 and 54. A stopper member shown generally at numeral 60 is positioned outwardly from the latch mechanism and is connected to the body section thereof by horizontal support 62. This stopper member has an inner vertical wall 64, an outer vertical wall 66 and a top surface 68. Between the stopper member and the latch body there is a vertical slot 70 which is vertically aligned with the principal slot in the horizontal latch engagement member. It will also be seen that the secondary slot 58 is vertically aligned with the top surface 68 of the stopper member. Those skilled in the art will appreciate that because of this vertical alignment, a relatively uncomplex mold component or combination of mold components may be used to form these slots in conventional injection molding procedures.

Referring particularly to FIGS. 11 through 15, a finger engagement portion shown generally at numeral 72 is illustrated which fits into the principal slot of the latch mechanism. This finger engagement portion has a lower section 74 which includes ends 76 and 78, outer side 80 and inner side 82. The finger engagement portion also includes an upper section which is made up of an upwardly and outwardly extending arm shown generally at numeral 84 which has a converging upper surface 86 and lower surface 88 which terminate at apex 90. Referring particularly to FIGS. 16 and 17, it will be seen that this finger engagement portion is engagable with the latch mechanism so that the edges abut the longitudinal arms of the latch engagement member and the rear side abuts the latch body while the front side abuts the transverse extensions of the longitudinal arm. It will also be noted that the secondary slot between these transverse extensions is aligned with the back stop member and will receive that back stop member when the latch body is flexed rearwardly.

It will be understood that the latch mechanism described herein may be integral with the housing or it may, either with or without the stopper, be separately molded and then attached to the housing. One example of an insertable latch is disclosed in U.S. Pat. No. 4,057,879.

Those skilled in the art will appreciate that this latch mechanism may be easily manufactured by injection molding. It will also be appreciated that its structure also allows for durability in its operation. Further, it will be appreciated that since the lever arm can easily be produced in a color different from the latch mechanism, the lever arm can be made visually distinctive and thereby facilitate its location and manipulation.

While the present invention has been described in connection with the preferred embodiments of the various figures, it is to be understood that other similar embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims.

What is claimed is:

1. A card edge connector assembly for releasably securing a circuit board having a front edge and opposite side edges, said connector assembly comprising:

(a) an elongated electrically insulative housing formed of a moldable material and having first and second opposed ends and defining an elongated channel in a surface of said housing and formed to receive the front edge of the circuit board;

(b) a first latch member positioned adjacent said first opposed end and comprising a body section extending from the housing to an upper end, a card engagement means extending inwardly from the body section adjacent the upper end to engage one of the side edges of the circuit board and a first latch manipulation platform means including first and second spaced longitudinal arms each having terminal ends and first and second transverse extensions projecting respectively toward each other from adjacent said terminal ends and wherein a principal slot is positioned between the first and second arms and a secondary slot is positioned between the first and second transverse extensions extending from the body section; and a first latch stopping means positioned outwardly adjacent said first latch member to prevent overstressing of said latch member wherein said latch stopping means is receivable in the secondary slot where the first latch member is flexed outwardly.

2. The card edge connector assembly of claim 1 wherein the first latch manipulation platform means extends generally perpendicularly outwardly from the body section.

3. The card edge connector assembly of claim 2 wherein the body section extends vertically from the housing.

4. The card edge connector assembly of claim 1 wherein the first latch member is molded integrally with the housing.

5. The card edge connector assembly of claim 1 wherein the first latch member is molded separately from the housing.

6. The card edge connector of claim 1 wherein a first latch stopping means is positioned outwardly adjacent said first latch member to prevent overstressing of said latch member.

7. The card edge connector of claim 1 wherein the first latch stopping means is connected to the body portion of the first latch by a first horizontal support member.

8. The card edge connector of claim 7 wherein the first principal slot is vertically aligned with the first horizontal support member.

9. The card edge connector of claim 8 wherein a pin extends vertically downwardly from the horizontal member.

10. The card edge connector of claim 9 wherein a first finger engagement means extends angularly upwardly and outwardly from the first latch manipulation platform means.

11. The card edge connector of claim 10 wherein the first finger engagement means has a lower vertical section which is engaged in the principal slot and an upper angular section.

12. The card edge connector of claim 11 wherein the outward latch stopping means is receivable in the first secondary slot.

13. The card edge connector of claim 1 wherein a vertical slot is positioned between the body section of the latch and the outward latch stopping means and said vertical slot is vertically aligned with the first principal slot.

14. The card edge connector of claim 1 wherein the stopping means has upper surface and said upper surface is vertically aligned with the secondary slot.

15. The card edge connector of claim 10 wherein the first finger engagement means has a color and the housing has a different color.

16. The card edge connector of claim 1 wherein a second latch member is positioned adjacent said second opposed end and is comprised of a body section extending from the housing to an upper end card engagement means extending inwardly from the body section to engage one of the side edges of the circuit board and a second latch manipulation platform means extends from the body section.

17. The card edge connector of claim 16 wherein a second latch stopping means is positioned outwardly adjacent said second latch member to prevent overstressing of said latch member.

18. The card edge connector of claim 17 wherein the second latch manipulation platform means member comprises a first and second parallel transverse spaced arm.

19. A card edge connector assembly for releasably securing a circuit board having a front edge and opposite side edges, said connector assembly comprising:

(a) an elongated electrically insulative housing having a first color and which is formed of a moldable material and having first and second opposed ends and defining an elongated channel in a surface of said housing and formed to receive the front edge of the circuit board;

(b) a first latch member positioned adjacent said first opposed end and comprising a body section extending from the housing to an upper end, a card engagement means extending inwardly from the body section adjacent the upper end to engage one of the side edges of the circuit board and a first latch manipulation platform means including first and second spaced longitudinal arms each having terminal ends and first and second transverse extensions projecting respectively toward each other from said terminal ends and wherein said longitudinal arms extend from said body such that a slot is formed between said longitudinal arms; and (c) a first finger engagement means having an upper angular section and a lower vertical section which is removably engageable in said slot and wherein said first finger engagement means has a second color which is different from said first color of said housing.

20. The card edge connector of claim 19 wherein there is a second latch member positioned adjacent said second opposed end and comprising a body section extending from the housing to an upper end, a card engagement means extending inwardly from the body section adjacent the upper end to engage one of the side edges of the circuit board and a second latch manipulation platform means including first and second spaced longitudinal arms each having terminal ends and first and second transverse extensions projecting respectively toward each other from said terminal end and wherein said longitudinal arms extend from said body such that a second slot is formed between said arms and a second finger engagement means having an upper angular section and a lower vertical section which is removably engageable in said second slot and wherein said second finger engagement means has a color which is different from said first color of said housing.

21. The card edge connector of claim 19 wherein the slot formed between the first and second longitudinal slot is a principal slot and a secondary slot is formed between the first and second transverse extensions.

* * * * *